US006981454B2

(12) United States Patent
Burdick

(10) Patent No.: US 6,981,454 B2
(45) Date of Patent: Jan. 3, 2006

(54) CENTER POST AND SYSTEM FOR A RACK

(75) Inventor: Terry Burdick, Fountain Valley, CA (US)

(73) Assignee: Cambro Manufacturing Co., Huntington Beach, CA (US)

( * ) Notice: Subject to any disclaimer, the term of this patent is extended or adjusted under 35 U.S.C. 154(b) by 40 days.

(21) Appl. No.: 10/273,733

(22) Filed: Oct. 18, 2002

(65) Prior Publication Data

US 2004/0074423 A1 Apr. 22, 2004

(51) Int. Cl.
*A47B 47/00* (2006.01)

(52) U.S. Cl. ..... 108/180; 403/331; 248/188.4

(58) Field of Classification Search ..... 108/55.1, 108/101, 187, 180; 211/134, 186, 188, 194; 248/346.02, 222.11, 223.41, 649, 650, 188.4; 403/331, 360, 363

See application file for complete search history.

(56) References Cited

U.S. PATENT DOCUMENTS

| | | | | | |
|---|---|---|---|---|---|
| 3,083,836 | A | * | 4/1963 | Bussemer | 211/134 |
| 3,207,095 | A | * | 9/1965 | Hiatt, Jr. | 108/53.5 |
| 3,225,487 | A | * | 12/1965 | Durham | 446/127 |
| 3,674,229 | A | * | 7/1972 | Keeler | 248/188 |
| 3,960,352 | A | * | 6/1976 | Plattner et al. | 248/309.1 |
| 4,313,586 | A | * | 2/1982 | Grzesnikowski | 248/188.4 |
| 4,998,023 | A | * | 3/1991 | Kitts | 280/47.35 |
| 5,887,878 | A | * | 3/1999 | Tisbo et al. | 280/47.19 |

FOREIGN PATENT DOCUMENTS

| | | | |
|---|---|---|---|
| EP | 686817 | * | 12/1995 |

* cited by examiner

*Primary Examiner*—Janet M. Wilkens
(74) *Attorney, Agent, or Firm*—George F. Bethel

(57) ABSTRACT

A shelving system having at least four posts with upper and lower traverses between the posts joined by dovetails on the posts and post connectors connecting the posts. A metal core forms the posts surrounded by plastic. A support post underlies at least one of the traverses having a metal interior portion and an exterior plastic with a foot at the base and an end cap distal from the foot for engaging the traverse.

16 Claims, 8 Drawing Sheets

CENTER POST AND SYSTEM FOR A RACK

BACKGROUND OF THE INVENTION

1. Field of the Invention

The field of this invention lies within the art of racks and shelving. More particularly, it lies within the art of supporting a rack and shelving with a number of posts, shelves, and cross members. The posts, shelves, and cross members can be formed of metal having a substantial plastic coating therearound to reduce rust and deterioration while at the same time having improved strength based upon an inner metal core.

2. The Prior Art

The prior art relates to shelving, particularly for usage with regard to food products in the institutional, industrial, and general restaurant food service art.

It has been found in the past that such shelving made of aluminum, steel, plastic, and other materials have substantial limitations. These limitations can be in the form of rust when it comes to steel, even though the steel has been painted. With respect to aluminum, the strength of the shelving is oftentimes compromised. As to the use of plastic for shelving without any strengthening, it has been found that such plastic can be formed and not be sufficiently strong to support such shelving.

Also, it has been well known in the food service area, particularly with regard to institutional, industrial, and restaurant food service activity, that substantial quantities of food must be stored on racks. The food must be readily accessible and at the same time visible to maintain proper inventories and availability.

The shelving, posts, and cross members of the invention hereof provide for excellent storage with respect to refrigerators and freezers based upon the ability to withstand varying temperatures.

The invention hereof overcomes the drawbacks of prior art shelving by being molded without welds and substantially avoids rust. To this extent, the combination with the plastic and steel core help to support the shelving hereof in a most desirable manner.

The weight bearing components are made of a steel core with a polypropylene or other suitable plastic exterior, thus making the shelving strong and easy to clean.

The prior art shelving when made of various metals as previously set forth does not enhance the weight bearing characteristics combined with low oxidation.

The shelving of this invention is based upon easy to use assembled components that provide for posts and cross members from which shelving can be suspended. The shelving is smooth with a polypropylene surface which is easy to clean and wipe. Liquid and dirt do not affect the overall characteristics of the shelving.

Regardless of the foregoing, it has been found that even with respect to the high strength steel that is used as the core as to the cross members, that sometimes the cross members will sag under significant load. To this extent, this invention overcomes the deficiencies of the prior art by providing a center post which enhances the overall support of members that are used for cross members in supporting the bending moment of the cross members of the shelving. As will be seen hereinafter, this invention substantially avoids cross member sag while at the same time maintaining the enhanced characteristics of the invention over the prior art as to metal and other types of shelving.

SUMMARY OF THE INVENTION

In summation, this invention provides for a shelving system having reinforced steel posts and cross members formed with a steel core to provide strength and durability with a plastic molded exterior surface to reduce rust and other deterioration while at the same time creating a system with a center post support for cross members to avoid sag and bowing of such cross members.

More specifically, the invention incorporates the aspects of posts, cross members, and various linkages with shelving. The posts and cross members can be formed with a steel core. The steel core provides strength and durability. At the same time, the steel core is formed with a molded surface therearound which can be a polypropylene or other type of suitable plastic.

The posts and cross members can be easily joined together by means of dovetails molded on the posts that mate with the cross members having molded dovetail receipt openings. Further to this extent, the cross members can be incorporated with the posts to form support in various directions as will be set forth hereinafter.

In order to enhance the support of the cross members, an adjustable mid support for the cross members is utilized which can be snapped into place and easily adjusted for various loads on the shelving supported by the cross members and the posts.

DESCRIPTION OF THE PREFERRED EMBODIMENTS

Figure 1:
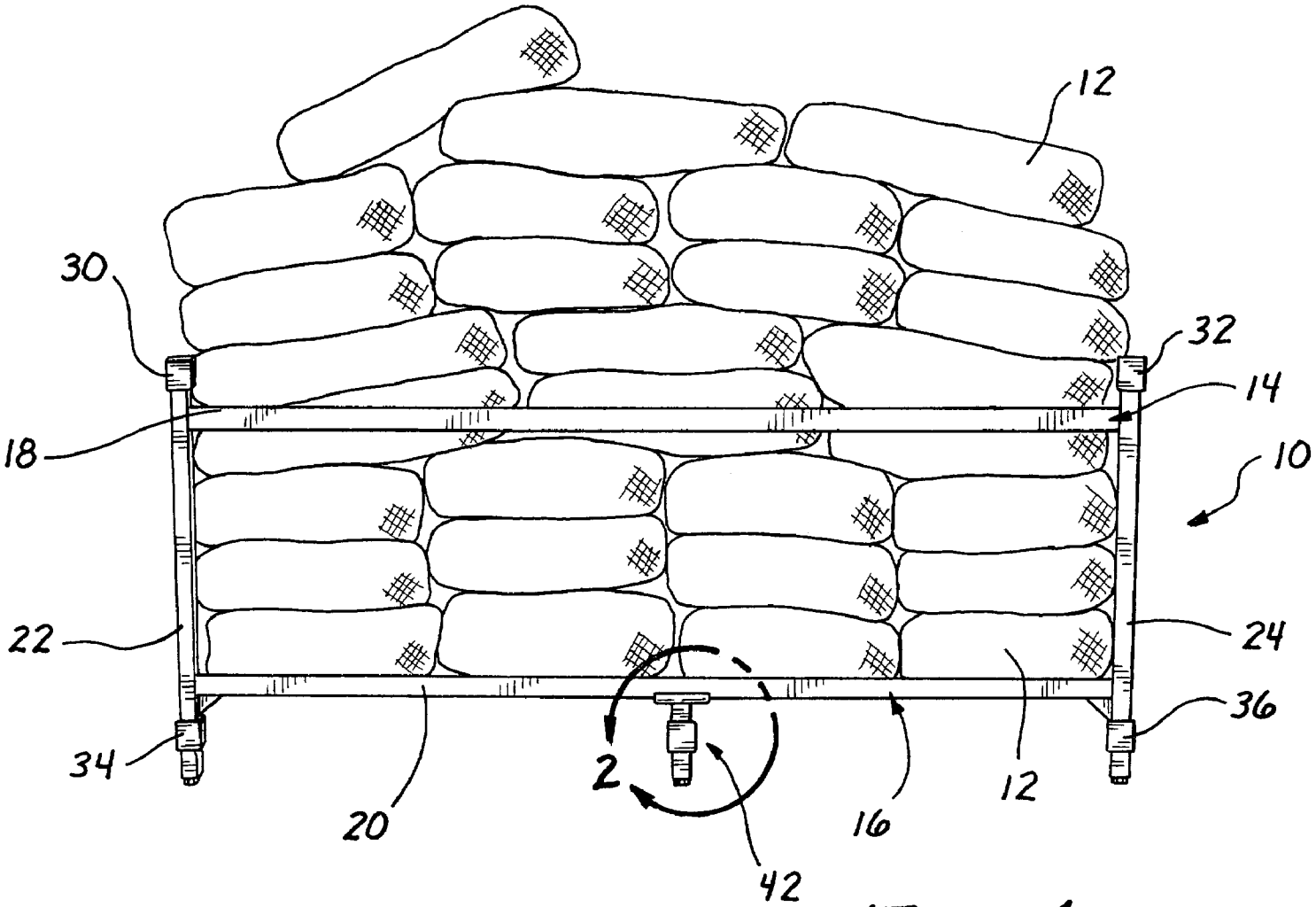
FIG. 1 shows a front elevation view of the shelving of this invention with a significant load thereon being supported in part by a center post.

Looking specifically at FIG. 1, it can be seen that the rack or shelving of this invention is shown generally as shelving 10. The rack or shelving 10 is supporting a plurality of sacks or bags 12 thereon. The plurality of sacks 12 are on an upper shelf 14 and a lower shelf 16. The shelving 14 and 16 is shown with a number of cross member supports that shall be referred to hereinafter as traverses 18 and 20.

The traverses 18 and 20 generally support the shelving between four posts 22 and 24. The posts 22 and 24 have a series of dovetailed receipt areas therein in order to receive dovetails of the traverses 18 and 20. Each respective dovetail on the posts 22 and 24 provides for an adjustment as to height and spacing of the traverses 18 and 20 that support the shelving. The dovetails can be interchanged as to receipt portions as projecting dovetails on either posts 22 and 24 or the traverses 18 and 20.

In order to connect the posts 22 and 24 a pair of upper post connectors 30 and 32 are utilized. These upper post connectors 30 and 32 have caps that slide over and are secured to the tops of the posts 22 and 24.

To provide for stability and support on the lower portion of the posts 22 and 24, post connectors 34 and 36 are utilized. These post connectors 34 and 36 slide upwardly onto the posts 22 and 24 so that cross stability is realized in both directions by the respective traverses and post connectors.

A number of various types of shelving can be extended or span between the traverses 18 and 20 so as to allow for the support and access of such items as bags 12 being accessed or any other types of items.

The foregoing configuration as to the dovetails and the posts 22 and 24 as well as the relationship of the traverses 18 and 20 and the post connectors 30, 32, 34, and 36 can be seen in European Patent 0686817A2 based on European Application 95201281.3 naming Hense, et al as inventors. The features of the foregoing patent assigned to the Assignee of the Applicant herein are incorporated herein by reference as to the dovetailed showings between the traverses 18 and 20 and the posts 22 and 24 as well as the respective post connectors. Also, the nature of the metal structure and core of that patent are included herein by reference as part of the supporting specification.

The rack according to the invention and the European Application: 95201281.3, now European Patent 0686817A2 is normally composed of at least two uprights and supports extending therebetween at different heights.

Each upright (i.e., posts 22 and 24) is composed of two upright tubes 201, which are connected to each other in the vicinity of the upper and lower ends by transverse connecting members, as will be described in detail hereafter. Each support (i.e., traverses 18 and 20) comprises two spars 202, on which plates preferably formed from synthetic material are laid. These plates do not form any part of the invention and are therefore only mentioned and illustrated incidentally in the description of the corner-connecting clip according to FIG. 1.

The upright tubes 201 consist of a metal core tube 3 preferably consisting of steel, preferably with a rectangular cross-sectional shape.

Figure 8:
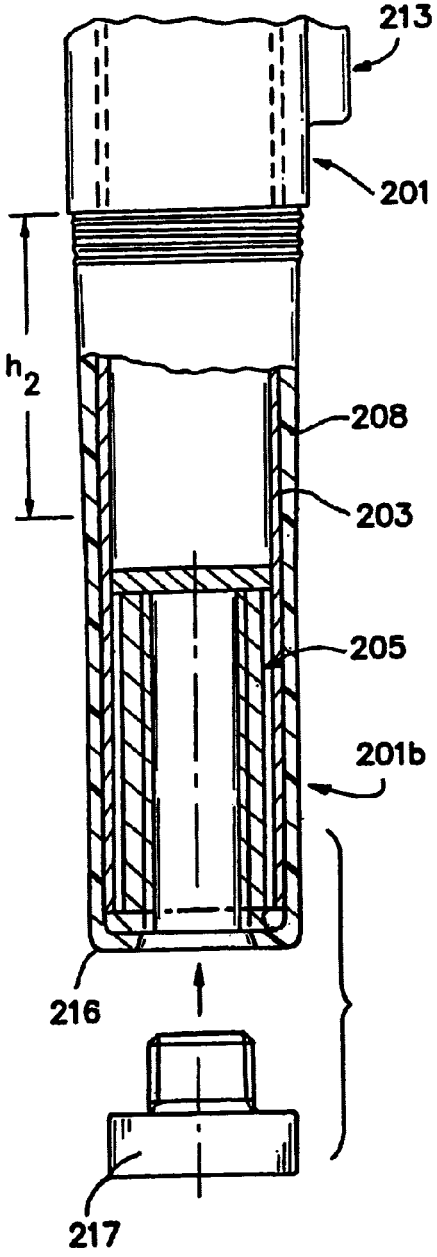
FIG. 8 is a side view of the lower end part of an upright tube.
Figure 7:
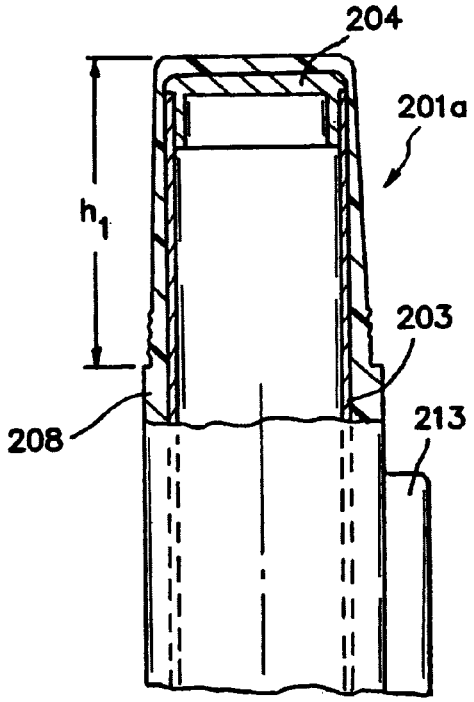
FIG. 7 shows the upper end part of an upright tube, partly in section.

The metal core tube 203 extends over the entire (standard) length (for example 1.8 m) of the upright tube and is provided at its upper end (see FIG. 7) and at its lower end (see FIG. 8) with an insert 204 or 205 closing off the respective end. In this case, the upper insert 204 is formed by a closure cap, whereas the lower insert 205 consists of an insert bush with a flange 206 resting on the front edge of the core tube 203 and with an internal thread for receiving an adjusting foot 207. The core tube 203 is provided over the entire length with a synthetic material covering (for example of polypropylene), which can be applied by known spraying methods and which likewise extends around the closed ends of the core tube.

Close to the upper and lower ends of the upright tube 201, the covering 208 has a wall thickness which over a certain height h1 (FIG. 7) or h2 (FIG. 8) is reduced in comparison with the remaining covering and decreases towards the respective front ends.

In the vicinity of the two ends, the upright tube thus has a section 201*a* or 201*b*, whereof the outer surface is slightly conical (for example with a concinnity of 2°).

Figure 9:
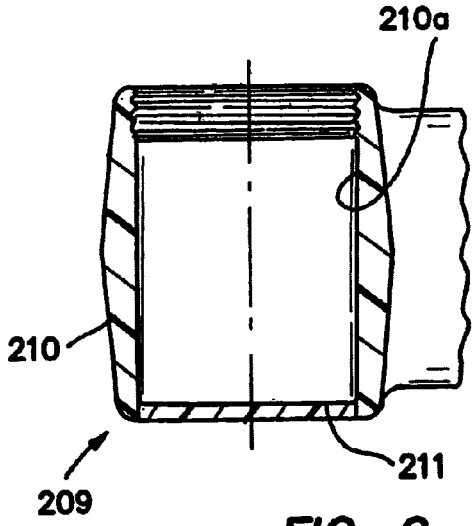
FIG. 9 shows an end section of a transverse connecting member between two upright tubes, in a vertical section.
Figure 11:
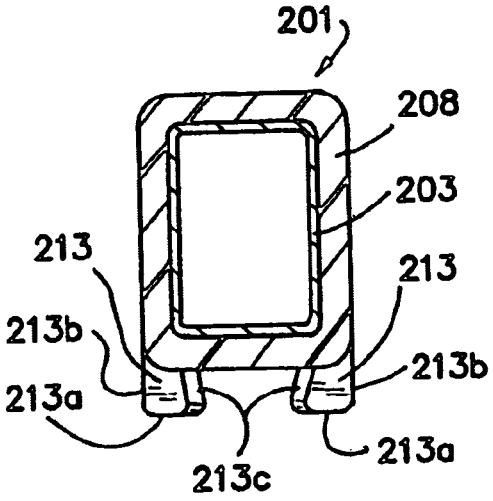
FIG. 11 is a cross-section on line VI—VI of FIG. 5.

These slightly conical end sections 201*a* or 201*b* form the engagement points for the bush-shaped ends 10 of a transverse connecting member 203, which is shown in FIG. 9 and whereof the cavity 210 has a shape and concinnity corresponding to those of the above-mentioned end sections 201*a* or 201*b*. The bush-shaped end sections of the transverse connecting members, which connect the upper ends of two upright tubes, may in this case, be closed at their tapered ends by a thin end wall 211. For connecting the lower ends of two upright tubes, an end wall of this type is omitted or removed.

It will become clear that two upright tubes 201 and the two transverse connecting members 209 can be assembled with a wedge action between the inter-engaging parts 201*a*, 210 or 201*b*, 210 of the upright tubes 201 and the transverse members 209 to form an upright which is resistant to bending and inherently stable.

The tubes 201 of each upright are provided with laterally projecting coupling parts 213. These coupling parts are in the form of elongated lugs extending in the longitudinal direction of the upright tube 201, whereof the longitudinal side 213, a remote from the upright tube, extends parallel to the axis of the upright tube and the two adjoining longitudinal sides 213*b* and 213*c*, lying opposite one another, diverge in the direction of the lower end of the respective upright tube.

The wedge-shaped lugs 213 obtained in this way are arranged in pairs, which are distributed uniformly over the length of the upright section. In this case, the distances between successive pairs of lugs correspond to the desired mutual spacing between the supports in the rack to be formed.

The lugs 213 all project from one longitudinal side of the upright section, in which case the longitudinal sides 213 remote from each other of the lugs 213 belonging to the same pair, lie in one plane with the adjoining longitudinal sides of the upright tube.

Furthermore, the longitudinal sides 213*c* of the lugs 213 form an angle less than 90° with the adjoining longitudinal side of the upright tube, due to which the lugs 213 have a cross-section whereof the profile towards the upright tube is undercut. As can be seen from the drawing, the lugs are rounded on the upper and lower ends. The lugs 213 are formed in one piece with the covering 8 supported by the core tube 203.

Figure 12:
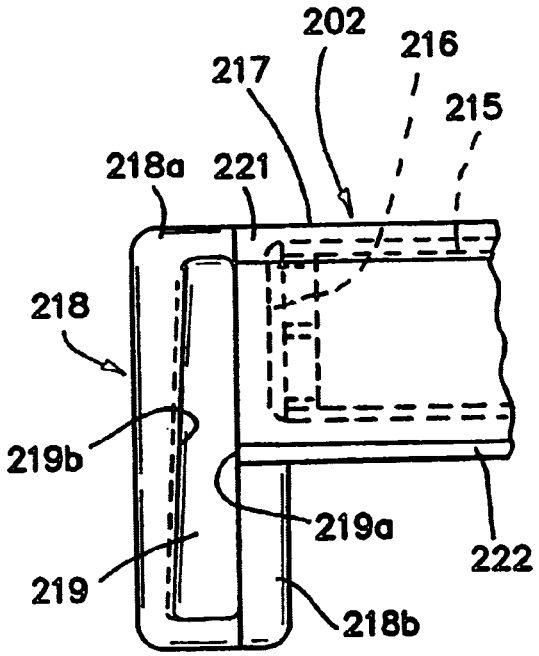
FIG. 12 is a side view of an end section of a spar, partly in longitudinal section.
Figure 10:
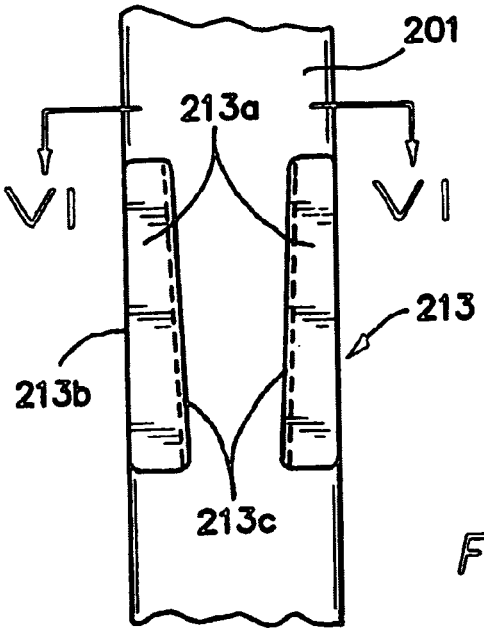
FIG. 10 is a side view of part of an upright tube with a pair of coupling lugs.

Reference is now made to FIG. 12, in which the spar 202 belonging to a support is shown in longitudinal section. In the same way as the above-described upright tube, the spar 202 also has a metal (preferably consisting of steel) tube core 215 with a preferably rectangular cross-sectional shape.

The metal core tube 215 closed at the ends with caps 216 is covered over its entire length, all around and around the ends with a synthetic material covering 217 of, for example, polypropylene. Coupling parts 218 formed in one piece with the covering 217 are provided at the ends of the spar 202. These coupling parts 218 are approximately in the shape of a 202 angle section, whereof the upper end lies in one plane with the upper wall of the spar and which projects on the under side to a certain extent below the spar. In this case, one flange 218*a* of the angle profile is displaced laterally to some extent with respect to the vertical central longitudinal surface of the spar 202, whereas the second flange 218*b* lies in one plane with the respective front end of the spar.

Provided in the flange 218*a* is a housing 219, whereof the side walls 219*a* and 219*b* have a mutual shape which corresponds to that of the opposite longitudinal sides 213*b* and 213*c* of the above-described coupling lug 213. In this case, the side wall 219*b* lies in one plane with the end face of the flange 218*b,* whereas the side wall 219*b* diverges downwards with respect to the side wall 219*a* and on the other side lies somewhat obliquely with respect to the bottom surface of the housing 219.

Figure 6:
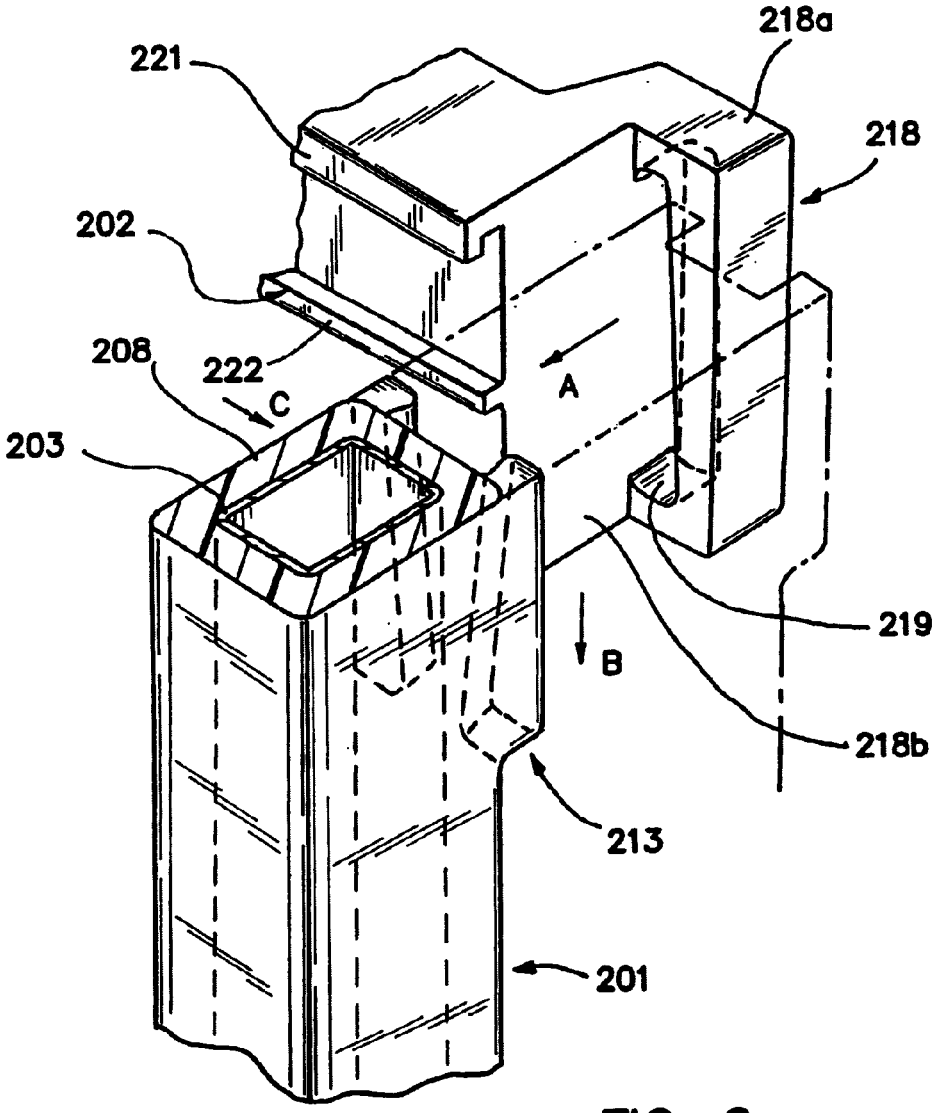
FIG. 6 is a perspective view of the disengaged connection between an upright tube and a spar in a rack according to the invention.

The length 212 of the housing 219 is at least so much greater than the length 211 of the lug 213, that the coupling part 218 with its housing 219 can be fitted from the side (see direction of arrow A in FIG. 6) on a coupling lug 213 projecting from an upright tube 201. If the coupling part 218 is moved downwards with respect to the upright tube 201 (see arrow B in FIG. 6), the lug 213 is clamped in the housing 219 under the wedge effect. This wedge effect accompanies the clamping of the spar 202 with respect to the respective upright tube in two mutually perpendicular directions, and indeed on the one hand in the direction of arrow A and on the other hand in the direction of arrow C (FIG. 6).

Figure 14:
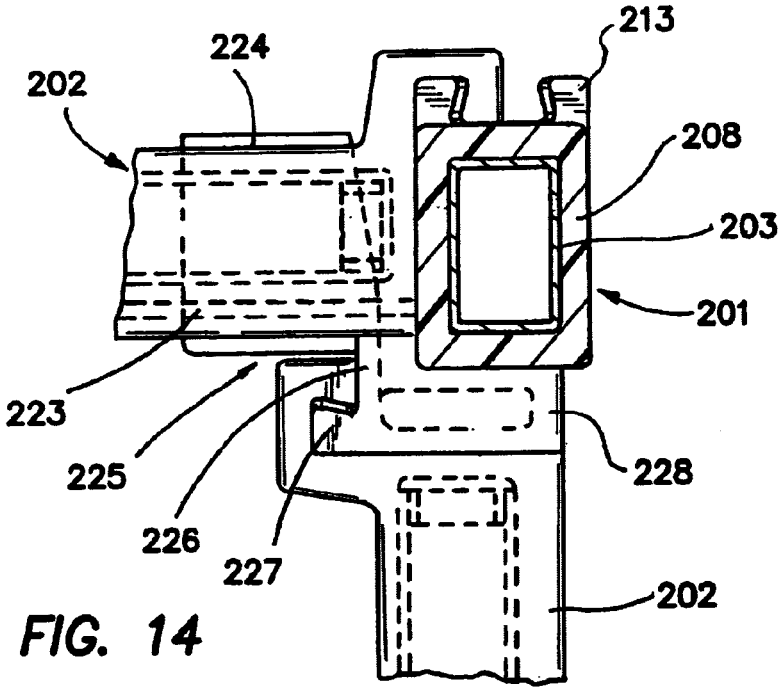
FIG. 14 is a horizontal section through the connection between an upright tube and two spars lying at right angles to each other.

The final coupling between the upright tube 201 and (i.e., posts 22 and 24) spar 202 (i.e., traverse 18 and 20) is illustrated in FIG. 14, in which it is furthermore shown how a second spar 202 lying at right angles to the spar 202 can be located by means of a corner-connecting clip 225.

In order that a rack formed by a first upright and an upright with supports located therebetween, can be enlarged by one section, which is at right angles to the first said rack and contains supports, which lie in one plane with those of the aforementioned rack, corner-connecting clips are used.

On that side of the rack, where the extension section is to be connected, two corner-connecting clips are placed around the spars of the supports, and indeed one close to one upright tube and a second at a point removed from the latter by the width of the support.

FIG. 14 shows the corner-connecting clip 225 to be located in the vicinity of the upright tube and preferably consisting of the same synthetic material as that of the covering of the upright tubes and spars. For locating the corner-connecting clips, on their outer longitudinal sides the spars are provided with an upper edge part 221 bent vertically downwards and a lower edge part 222, which edge parts together form a housing for the upright leg 223 of an angle clip 225*a,* whereof the horizontal leg 224 may engage resiliently around the lower side of the spar 202 (see FIG. 13). The angle clip 225*a* supports a web 226 projecting vertically, with a coupling lug 227 provided thereon, which corresponds to the coupling lug 213 seated on the upright tubes.

In this way, two coupling lugs are formed at two points on the side edge of each support of the rack to be extended at right angles, on which coupling lugs just as many spars can engage, which spars are connected by their other ends to the coupling lugs on the upright tubes of a third upright.

Provided on the side of the web 226 remote from the lug 227 is a projection 228 (see FIG. 14), which fills the space between the front end of the spar 202 and the opposite wall of the upright 201. A similar projection can be used in the corner-connecting clip, which is to be hooked around the spar 202 at an intermediate point.

Figure 13:
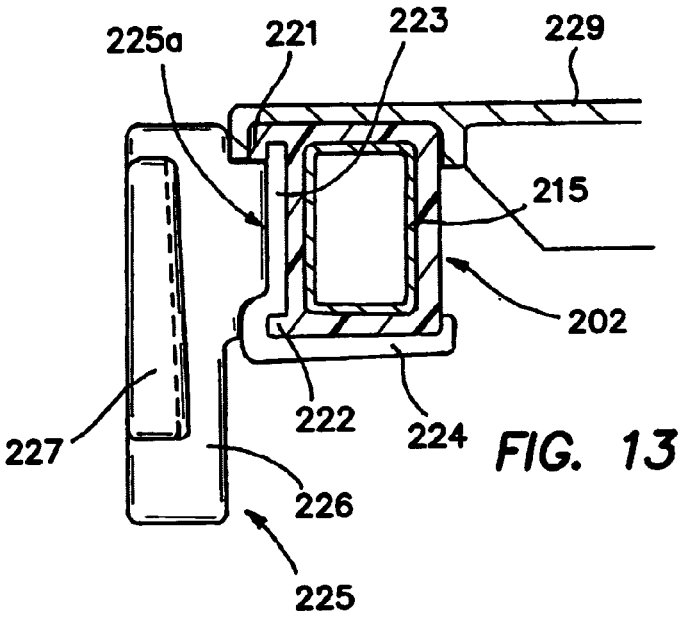
FIG. 13 is a cross-section through a spar with a corner-connecting clip hooking laterally around the latter.

Finally, FIG. 13 shows part of the synthetic material plates 229, which are laid overlapping the spars 202 or 202.

Figures 6A, 15:
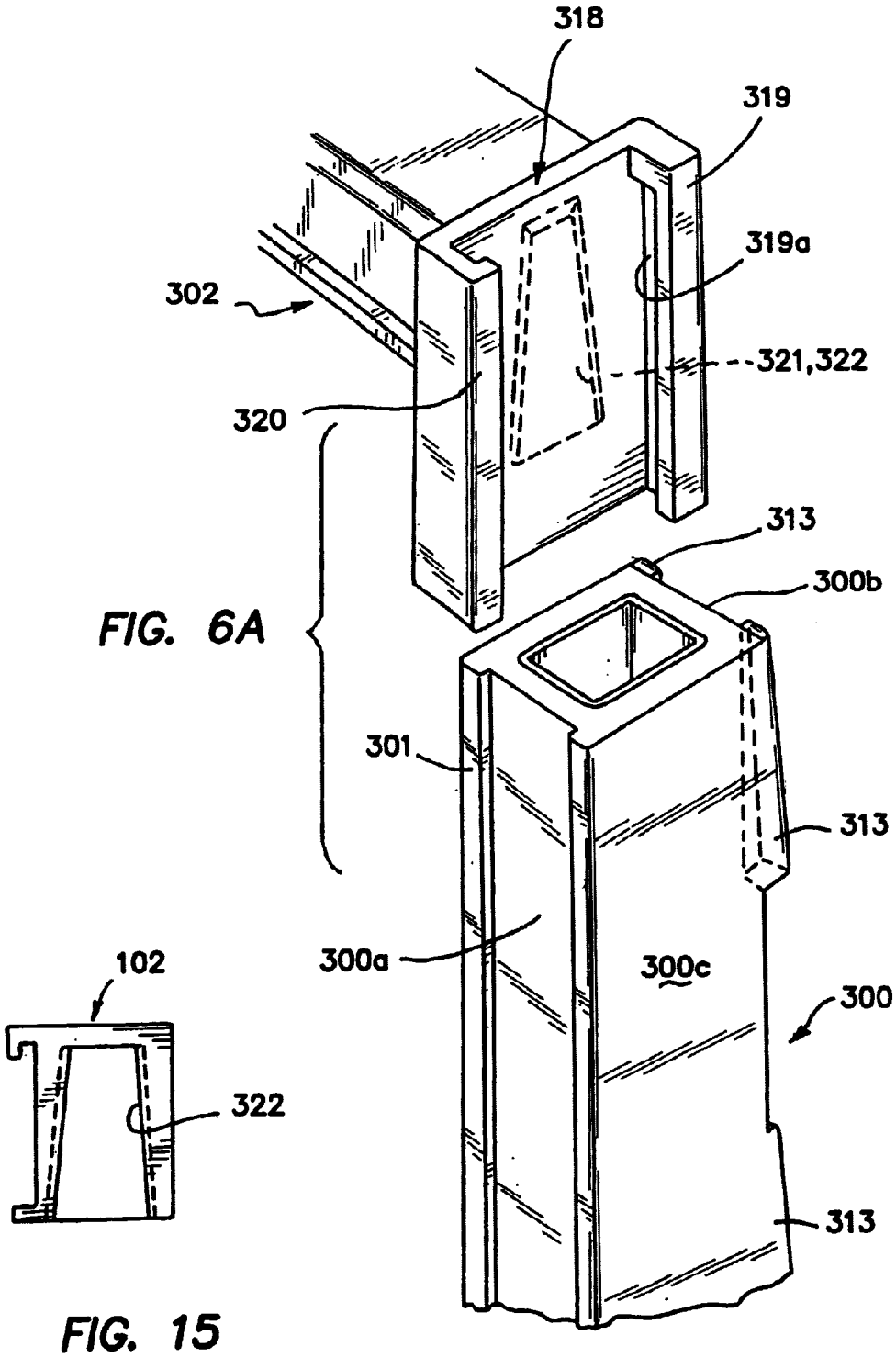
FIG. 6A shows a modification of the connection according to FIG. 1.
FIG. 15 is an end view, to a reduced scale, of the spar, with the coupling part removed, in the embodiment according to FIG. 6A.

In the embodiment according to FIG. 6A, the upright 300 is provided on one side 300*a* with longitudinal ribs 301 of invariable cross-section and with coupling lugs 313 on the opposite side 300*b*. These coupling lugs 313 consequently differ from the lugs 213 in the embodiment according to FIG. 6 in that they diverge downwards solely in one direction, and indeed in the plane of the adjoining side 300*c* or 300*d* of the upright.

In the embodiment according to FIG. 6A, the spar 302 is provided with a coupling part 318, which differs from the coupling part 218 in the embodiment according to FIG. 6 due to the fact that it is set up for cooperation with both a longitudinal rib 301 as well as an opposing lug 313 of the upright 300. For this purpose, the coupling part is bent over twice at right angles on one vertical longitudinal edge at 320, in order that it can engage around a rib 301, whereas the opposite longitudinal edge 319 is likewise bent twice at right angles. However, in this case, the surface 319*a* has a downwardly diverging shape corresponding to the wedge shape of the lug 313 of the upright 300 to be surrounded.

Furthermore, the coupling part 318 is constructed as a separate synthetic material part and on the rear side is provided with an integrally formed projection 321 with a cross-section in the shape of a dovetail and widening out downwards in the shape of a wedge, which fits in a correspondingly shaped recess 322 in the front end of the spar 302 (see FIG. 15). Moreover, the upright 300 and the spar may be constructed in the same manner as was described above in connection with the embodiment according to FIG. 6.

Figure 3:
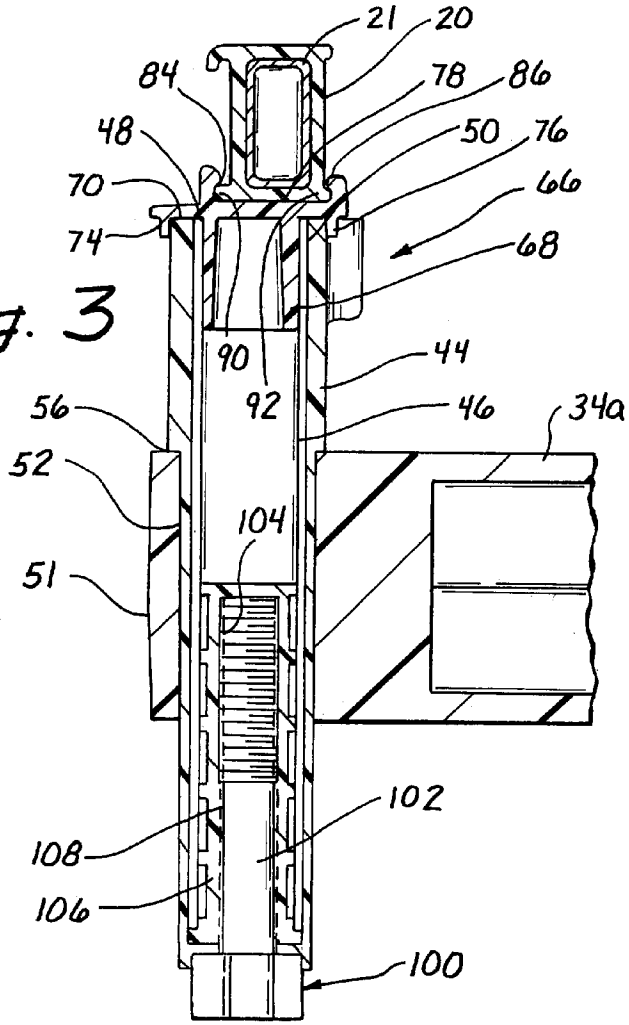
FIG. 3 shows a sectional view of the center post in the direction of lines 3—3 of FIG. 2.
Figure 2:
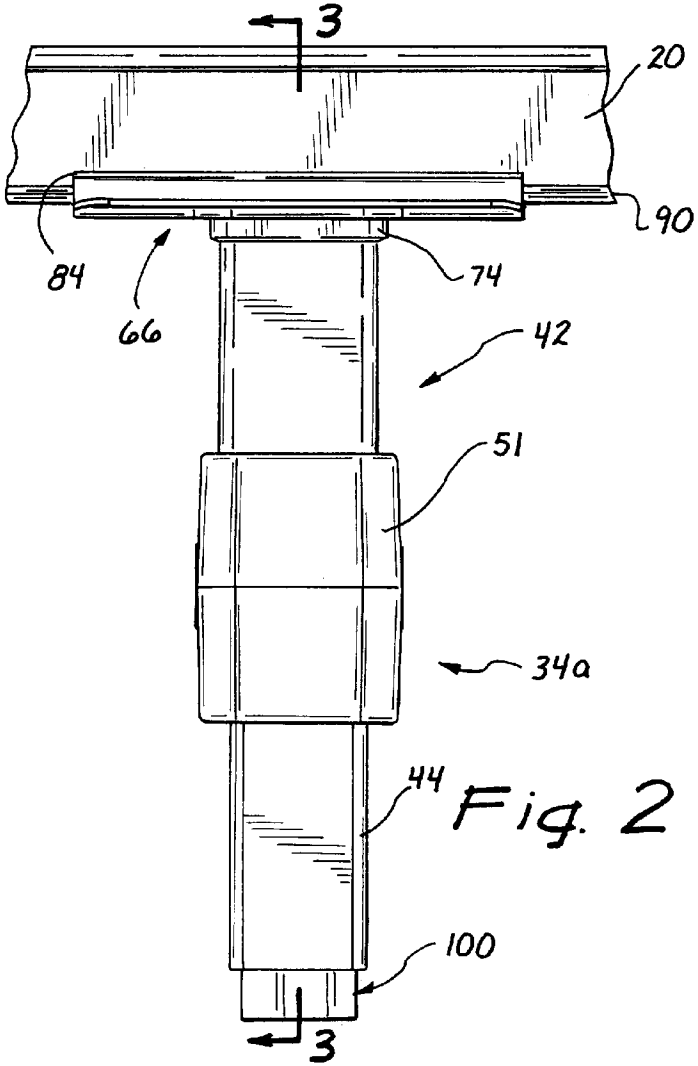
FIG. 2 shows a detailed fragmented portion that has been encircled by circle 2 of FIG. 1.
Figure 4:
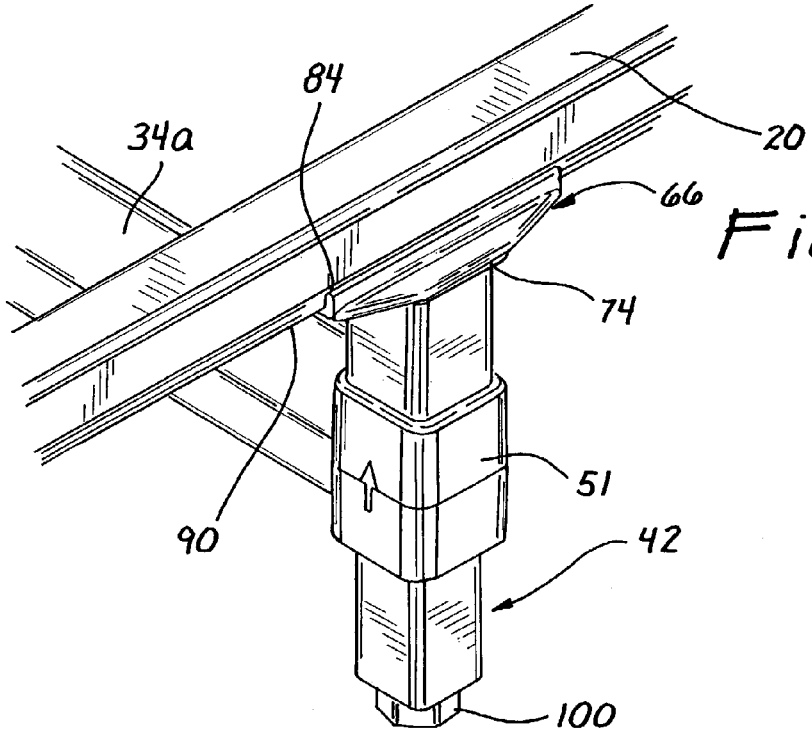
FIG. 4 shows a fragmented perspective view of the center post and cross members.
Figure 5:
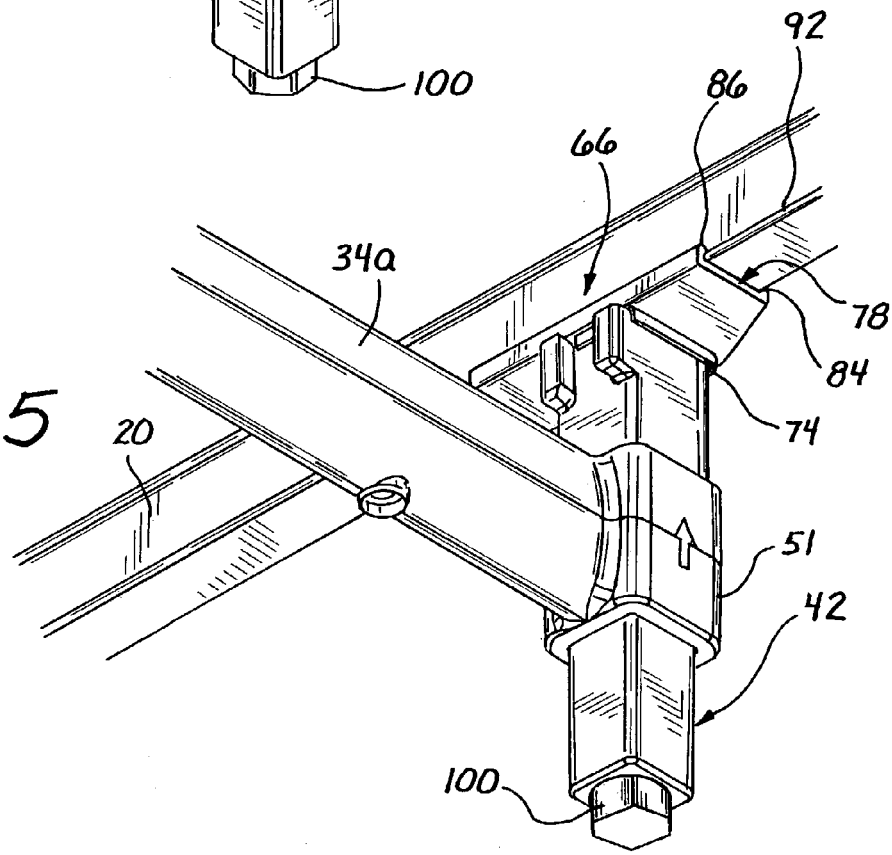
FIG. 5 shows a fragmented perspective view looking upwardly at the center post and cross members.

Looking more specifically at FIGS. 2 and 3 which have been encircled from circle 2 of FIG. 1 it can be seen that a center post is shown with a portion of a traverse. In particular, the lower traverse 20 is shown connected to a center post 42. The center post 42 is comprised of an outer molded column section 44 having an interior steel tubular reinforcement 46. The interior steel reinforcement 46 is of a columnar nature and terminates at an abutment end 48 co-terminus with the end of the outer plastic portion 44 and a co-terminal point 50.

In order to maintain the rigidity of the center post 42 underneath the traverse 20, a cross member that can be in the form of a post connector 34*a* has been shown. The cross member 34*a* has the interior portion thereof at the end formed as an opening 52 in a collar 51 which can circumscribe the outer plastic portion 44. The collar portion 51 with the space 52 terminates against a ledge or small dimension portion 56 of the outside plastic portion 44 of the post 42.

In order to seat the traverse 20 on the center post 42, an end cap 66 is shown. The end cap 66 has an insert 68 that inserts into the metal portion 46 of the center column. The end cap 66 with its insert 68 terminates with an upper flattened portion on the interior forming a channel or receipt 70 into which the portions 44 and 46 of the center post 42 can be inserted. In order to secure them, an exterior flange 74 and 76 is shown.

The end cap 66 extends upwardly to provide an elongated channel 78 that extends along its length which is spilled over in the form of longitudinal flanges 84 and 86. These longitudinal flanges 84 and 86 receive the traverse 20 therein based upon lower flanges 90 and 92 on either side of the traverse.

In this manner, the traverse 20 with its interior steel portion 21 can be well supported on the center post 42 with the corresponding post connector 34 stabilizing it.

In order to adjustably seat the center or support post 42 on a surface to support the traverse 20, an adjustable end or base foot 100 is seated therein. The adjustable end foot 100 has a metal extension or column 102 which can be in the form of any suitable material terminating in threads 104. The threads 104 are seated within a metal or plastic sleeve 106 having matching threads. The sleeve 106 with its matching threads 108 allows for adjustment upwardly or downwardly of the foot 100 on its column 102. Thus, after the sleeve is inserted and formed in any suitable manner to be retained within the metal portion of the column 46, it can be adjusted as to the foot 100 upwardly and downwardly for centering and balancing the shelving 10.

Various alternatives can be utilized with the invention hereof such as the substitution of steel with hard durable plastic as well as the utilization of steel for instance in the post connectors in the analogous manner to which the tubular steel support 21 has been emplaced within the traverse 20. Also, various types of plastic can be utilized for molding around the steel core as set forth hereinafter.

Inasmuch as the plastic coating or molded covering should be food compatible and meet with FDA food-contact regulations, polycarbonate is deemed desirable and is well received. Polycarbonate is further desirable because of its clarity.

Other preferred plastics include among others polyethylenes, polypropylenes, and styrenic resins, in particular, styrene-acrylonitrile (SAN) and acrylonitrile-butadiene-styrene (ABS).

The invention can be made from many other plastic materials besides those preferred plastic materials mentioned above. When intended for food use, any of the resins and polymers approved for food use by the Food and Drug Administration can be used keeping in mind that chemically compatible material provides a better bond. Examples of such plastic materials can include among others the homopolymers, copolymers, polymers and mixtures thereof containing:

Acrylic and modified acrylic plastics;
Acrylonitrile/butadiene/styrene copolymers;
Acrylonitrile/butadiene/styrene/methyl methacrylate copolymers;
Acrylonitrile/styrene copolymers;
Acrylonitrile/styrene copolymer modified with butadiene/styrene elastomers;
n-Alkylglutarimide/acrylic copolymers;
Cellophanes;
Cross-linked polyacrylate copolymers;
1,4-Cyclohexylene dimethylene terephthalate and 1,4-Cyclohexylene dimethylene isophthalate copolymers;
Ethylene-acrylic acid copolymers;
Ethylene-carbon monoxide copolymers.
Ethylene-1,4-cyclohexylene dimethylene terephthalate copolymers;
Ethylene-ethyl acrylate copolymers.
Ionomeric resins;
Ethylene-methyl acrylate copolymer resins;
Ethylene/1,3-phenylene oxyethylene isophthalate/terephthalate copolymers;
Ethylene-vinyl acetate copolymers;
Ethylene-vinyl acetate-vinyl alcohol copolymers;
Fluorocarbon resins;
Isobutylene polymers;
Isobutylene-butene copolymers;
Melamine-formaldehyde resins;
Nitrile rubber modified acrylonitrile-methyl acrylate copolymers;
Nylon resins;
Olefin polymers;
Perfluorocarbon resins;
Polyarylate resins;
Polyaryletherketone resins;
Polyarylsulfone resins;
Poly-1-butene resins and butene/ethylene copolymers;
Polycarbonate resins;
Polyestercarbonate resins;
Polyester elastomers;
Polyetherimide resins;
Polyethylene resins, carboxyl modified;
Polyethylenes, chlorinated;
Polyethylenes, fluorinated;
Polyethylenes, oxidized;
Polyethylene phthalate polymers;
Poly(phenyleneterephthalamide)resins;
Poly(p-methylstyrenes) and rubber-modified poly(p-methylstyrenes);
Poly(oxy-1,2-ethanediyloxycarbonyl-2,6-naphthalenediylcarbonyl)resins;
Polystyrenes and rubber-modified polystyrenes;
Polysulfide polymer-polyepoxy resins;
Polysulfone resins;
Poly(tetramethylene terephthalates);
Polyurethane resins;
Styrene block polymers;
Styrene-maleic anhydride copolymers;
Styrene-methyl methacrylate copolymers;
Textryls;
Urea-formaldehyde resins;
Vinyl chloride-ethylene copolymers;
Vinyl chloride-hexene-1 copolymers;
Vinyl chloride-lauryl vinyl ether copolymers;
Vinyl chloride-propylene copolymers;
Vinylidene chloride/methyl acrylate copolymers; and,
Vinylidene chloride/methyl acrylate/methyl methacrylate polymers.

The above list is only intended to be illustrative of the plastics which can be used and is not intended to constitute a limitation to the structure of this invention. Other plastic materials and mixtures thereof will be apparent to one skilled in the art and can be used without departing from the spirit and scope of the invention.

What is claimed is:

1. Shelving system for shelving comprising:
at least four posts for supporting said shelving;
an upper and lower traverse between pairs of said posts;
a dovetail on said posts for receiving said traverses;
a post connector connecting said posts;
a metal core in said posts surrounded by a plastic cover;
a metal core within said traverses for reinforcing said traverses and surrounded by a plastic coating;
a support post underlying at least one of said traverses suitable for placement against a support surface underlying said support post and having a metal interior portion and an exterior plastic coating;
a foot at the base of said support post;
said at least one of said traverses having at least one longitudinal flange; and an end cap on said support post distal from said foot for engaging said traverses having an undercut on an upper portion thereof for receiving said longitudinal flange of said traverse.

2. The shelving system as claimed in claim 1 further comprising:

at least one said support post underlying each of said lower traverses;

a support post connector extending between said support posts; and, wherein said foot of each post is adjustable for adjusting the height of said support posts.

3. The shelving system as claimed in claim 2 further comprising; each said support post has a threaded sleeve therein; and, the adjustability of said foot of each post is provided by a threaded column that threads into the interior sleeve of said support post.

4. The shelving system as claimed in claim 1 further comprising; at least two longitudinal exterior flanges on said at least one of said traverses, and, two undercuts on said end cap for each receiving said flanges of said at least one of said traverses.

5. The shelving system as claimed claim 1 further comprising:

said metal core for said support posts, and said traverses, and said posts are formed from a metal tube; and, said plastic coating is injection molded onto the surface of said tube.

6. Shelving comprising:

at least four posts formed from a tube of metal having an exterior plastic coating molded thereon with dovetails;

a plurality of traverses for extending between said posts having end portions that seat within said dovetail portions of said posts, said traverses being formed of a metal tubular portion having a plastic configuration therearound and wherein said ends of said traverses have a plastic dovetail matching segment for seating on said posts; a support post for seating under the lowest traverses, said support post having a cap at one end with a pair of elongated uprights, each forming a flange with an undercut for receiving said traverses, and a foot at the other end; and, said traverses having a flange for receipt within said undercut of said cap.

7. The shelving as claimed in claim 6 further comprising:

said foot is adjustable for varying the length of said support post.

8. The shelving as claimed in claim 6 further comprising:

said support post being formed of a metal tubular member with a plastic surrounding said tubular member.

9. The shelving as claimed claim 8 further comprising:

a post connector extending between two support posts.

10. The shelving as claimed in claim 9 further comprising:

a threaded portion within the metal portion of each of said support posts and a matching threaded column attached to said foot for screw adjustment of said foot upwardly and downwardly to adjust the length of said support post.

11. The shelving as claimed in claim 10 further comprising:

said metal tubular structure forming said posts and said traverses have a molded polypropylene portion therearound having inter engaging dovetailed portions.

12. A method for support shelving comprising:

providing at least four posts formed with tubular metal portions surrounded by a plastic material;

providing a pair of upper and lower traverses formed of a metal tubular portion surrounded by a plastic;

supporting the ends of said traverses on said posts by means of matching dovetailed engagements between said traverses and said posts;

providing post connectors between said posts; providing at least one support post beneath the lowest traverses having a tubular metal portion and an external plastic molded portion;

providing a threaded adjustment foot on said underlying support post;

adjusting the height of said underlying support post by threaded movement of said foot;

providing an end cap to said support post; and, engaging one of said traverses by said end cap.

13. The method as claimed in claim 12 further comprising:

providing external longitudinal flanges on said traverses; and, engaging said flanges of one of the tranverses on said end cap of said support post.

14. The method as claimed in claim 13 further comprising:

providing flanges with a channel on said end cap; and, engaging said flanges of said traverse within said channel.

15. The method as claimed in claim 14 further comprising:

providing an interior sleeve to said support post interior to the metal tubular portion thereof; and, providing a threaded engagement between a column and the foot of said support post for adjusting said foot with respect to the surface on which said shelving is placed.

16. The method as claimed in claim 15 further comprising:

molding said dovetail engagements at the end of said traverses and on said posts of a plastic wherein said posts receive the ends of said traverses in a plastic dovetailed configuration.

* * * * *